US010676910B2

(12) United States Patent
Simon et al.

(10) Patent No.: US 10,676,910 B2
(45) Date of Patent: Jun. 9, 2020

(54) DRAINAGE DEVICE AND METHODS FOR CONSTRUCTING AND USE

(71) Applicant: ABT, INC., Troutman, NC (US)

(72) Inventors: Tom Simon, Statesville, NC (US); Frank Sherrill, Statesville, NC (US); Blake Locke, Houston, TX (US)

(73) Assignee: ABT, INC., Troutman, NC (US)

( * ) Notice: Subject to any disclaimer, the term of this patent is extended or adjusted under 35 U.S.C. 154(b) by 0 days.

(21) Appl. No.: 14/907,526

(22) PCT Filed: Jul. 25, 2014

(86) PCT No.: PCT/US2014/048302
§ 371 (c)(1),
(2) Date: Jan. 25, 2016

(87) PCT Pub. No.: WO2015/013682
PCT Pub. Date: Jan. 29, 2015

(65) Prior Publication Data

US 2016/0362883 A1 Dec. 15, 2016

Related U.S. Application Data

(60) Provisional application No. 61/858,546, filed on Jul. 25, 2013.

(51) Int. Cl.
*E01F 5/00* (2006.01)
*E03F 5/04* (2006.01)
(Continued)

(52) U.S. Cl.
CPC ..... *E03F 5/0404* (2013.01); *E01C 11/227* (2013.01); *E03F 5/06* (2013.01)

(58) Field of Classification Search
USPC ..... 404/4; 210/163, 170.03
See application file for complete search history.

(56) References Cited

U.S. PATENT DOCUMENTS 571,711 A * 11/1896 Twist ..... E04D 13/0645 210/162
1,269,779 A * 6/1918 Bell ..... B01D 21/0012 210/155

(Continued)

OTHER PUBLICATIONS

U.S. Patent & Trademark Office. PCT International Search Report and Written Opinion dated Nov. 14, 2014. International Patent Application No. PCT/US2014/048302. International Filing Date: Jul. 25, 2014. English Language. 8 pages.

(Continued)

*Primary Examiner* — Thomas B Will
*Assistant Examiner* — Katherine J Chu
(74) *Attorney, Agent, or Firm* — Moore & Van Allen, PLLC; Henry B. Ward, III

(57) ABSTRACT

The present invention embodies a drainage device that is used for controlling the flow of rainwater during the first flush of rainfall. The drainage device includes a basin configured to receive rainwater or other liquids from an adjacent driving surface roadway through a drain (e.g., a grate). The interior of the basin encloses a plurality of pollution collection members (e.g., lattices) configured to trap pollutants in the rainwater for extraction from the rainwater. The pollution collection members are angled so as to increase the surface area that is exposed to rainwater entering and received within the drainage device (also referred to herein as the "outside surface" of the pollution collection members). The pollution collection members are configured to trap pollutants. The outside surfaces of the pollution collection members may be covered in a fabric that increases efficiency in filtering pollutants from the rainwater.

13 Claims, 3 Drawing Sheets

(51) Int. Cl.
*E01C 11/22* (2006.01)
*E03F 5/06* (2006.01)

(56) References Cited

U.S. PATENT DOCUMENTS

| | | | | | |
|---|---|---|---|---|---|
| 1,561,120 | A * | 11/1925 | Smith | E03F 5/04 | 210/164 |
| 2,586,967 | A * | 2/1952 | Lundy, Sr. | E03F 5/0401 | 210/300 |
| 2,615,526 | A * | 10/1952 | Lane | E03F 5/0405 | 210/164 |
| 2,800,231 | A * | 7/1957 | Hicks | E03C 1/264 | 210/163 |
| 5,573,350 | A | 11/1996 | Stegall | | |
| 5,744,048 | A * | 4/1998 | Stetler | E03F 5/0401 | 210/164 |
| 6,106,707 | A * | 8/2000 | Morris | B01D 17/00 | 210/163 |
| 6,531,059 | B1 * | 3/2003 | Morris | B01D 29/012 | 210/164 |
| 6,537,446 | B1 | 3/2003 | Sanguinetti | | |
| 6,998,038 | B2 * | 2/2006 | Howard | B01D 29/114 | 210/111 |
| 7,112,274 | B1 * | 9/2006 | Sanguinetti | B01D 29/01 | 210/163 |
| 7,178,675 | B2 * | 2/2007 | Votel | A47L 17/02 | 210/232 |
| 7,258,785 | B2 * | 8/2007 | Weir | E03F 1/00 | 210/163 |
| 7,270,747 | B2 * | 9/2007 | Happel | E03F 1/00 | 210/162 |
| 7,468,129 | B2 * | 12/2008 | Landry, Sr. | C02F 1/681 | 210/155 |
| 7,875,178 | B2 | 1/2011 | Ashliman | | |
| 7,946,784 | B2 * | 5/2011 | Knak | E03F 5/06 | 14/73.1 |
| 8,012,346 | B2 * | 9/2011 | Peters, Jr. | C02F 1/004 | 210/163 |
| 8,287,726 | B2 * | 10/2012 | Williams | B01D 35/10 | 210/108 |
| 9,719,240 | B1 * | 8/2017 | Montague | E03F 5/0404 | |
| 10,294,655 | B2 * | 5/2019 | Murphy, III | E03F 5/14 | |
| 2002/0048490 | A1 * | 4/2002 | Allard | B01D 29/27 | 405/43 |
| 2004/0035772 | A1 * | 2/2004 | McGinn | B01D 29/111 | 210/163 |
| 2004/0099586 | A1 * | 5/2004 | Imoto | E03F 5/0405 | 210/85 |
| 2004/0256298 | A1 * | 12/2004 | Curtolo | E03F 1/00 | 210/163 |
| 2005/0067338 | A1 * | 3/2005 | Page | E03F 1/00 | 210/164 |
| 2005/0230317 | A1 | 10/2005 | Belasco et al. | | |
| 2008/0073277 | A1 * | 3/2008 | Paoluccio | B01D 21/0012 | 210/691 |
| 2011/0139694 | A1 * | 6/2011 | Mondschein | E03F 5/0404 | 210/163 |
| 2013/0008851 | A1 * | 1/2013 | Jarvis, Jr. | E03F 5/0404 | 210/499 |
| 2013/0020242 | A1 * | 1/2013 | Vreeland | E03F 5/0404 | 210/163 |
| 2013/0056399 | A1 | 3/2013 | Downare | | |
| 2014/0097133 | A1 * | 4/2014 | Flury | E03F 5/046 | 210/170.03 |
| 2015/0259896 | A1 * | 9/2015 | Jarvis | E03F 5/14 | 210/131 |
| 2017/0342698 | A1 * | 11/2017 | Fink | E03F 5/14 | |
| 2018/0112386 | A1 * | 4/2018 | Coppola | E03F 5/16 | |

OTHER PUBLICATIONS

International Preliminary Report on Patentability for PCT/US2014/048302 dated Jan. 26, 2016.

Canadian Office Acton for corresponding Canadian Patent Application No. 2,920,613 dated Mar. 10, 2017.

Canadian Office Action for corresponding Canadian Patent Application No. 2,920,613 dated Nov. 16, 2018.

Office Action issued by the Mexican Patent Office for Mexican Patent Application No. MX/a/2016/001064 dated Mar. 27, 2019.

Office Action issued by the Canadian Intellectual Property Office for Canadian Patent Application No. 2,920,613 dated Sep. 13, 2019.

* cited by examiner

DRAINAGE DEVICE AND METHODS FOR CONSTRUCTING AND USE

BACKGROUND

During the "first flush" (i.e., the first fifteen (15) to twenty (20) minutes) of rainfall, a majority of loose sediments, oils and other pollutants are picked up and carried by rainwater off surfaces such as sidewalks, driveways and roadways. While the driving surface of most roadways typically allows for a predetermined spread of standing rainwater, there is a need to efficiently redistribute and control the flow of rainwater around the driving surface to minimize the risk of hydroplaning. Conventionally, rainwater is channeled, plumbed (and may even be pumped) away from the driving surface and into an oil/water separator, a separation tank, a retention pond, or a similar rainwater management or sediment separation device. The purposes of these devices is to control the allowable spread of standing rainwater on the driving surface, which increases the safe speed at which cars may move along the road, as well as to help keep fresh water sources clean and free of pollutants as the rainwater is recycled back into the water source system after it has been processed in some manner to remove pollutants. As used herein, "pollutants" comprise sediments, oils, debris, and other solids and chemicals found in surface water runoff.

BRIEF SUMMARY OF THE INVENTION

The present invention embodies a drainage device that is used for controlling the flow of rainwater during the first flush of rainfall. The drainage device includes a basin configured to receive rainwater or other liquids from an adjacent driving surface roadway through a drain (e.g., a grate). The interior of the basin encloses a plurality of pollution collection members (e.g., lattices) configured to trap pollutants in the rainwater for extraction from the rainwater. The pollution collection members are angled so as to increase the surface area that is exposed to rainwater entering and received within the drainage device (also referred to herein as the "outside surface" of the pollution collection members). The pollution collection members are configured to trap pollutants. The outside surfaces of the pollution collection members may be covered in a fabric that increases efficiency in filtering pollutants from the rainwater.

In some embodiments, a liquid drainage apparatus is provided. The apparatus comprises: a basin defining an interior to receive the liquids and an aperture through which the received liquids are channeled; a grate, the grate being supported by the basin, wherein the grate comprises a plurality of openings so as to enable the liquids to flow therethrough and into the interior of the basin; at least one pollutant collection member, the at least one pollutant collection member being porous and being disposed within the basin such that a substantial portion of the liquids received within the interior of the basin will impinge upon the pollutant collection member at an angle.

In some embodiments, the at least one pollutant collection member comprises a support member and a filtration member secured to the support member.

In some embodiments, the support member comprises a lattice and at least one angled flange.

In some embodiments, the filtration member comprises a plurality of layers.

In some embodiments, at least one of the plurality of layers comprises a polypropylene fabric.

In some embodiments, at least one of the plurality of layers comprises a geo-textile fabric.

In some embodiments, the at least one angled flange is hinged to the basin such that the support member and filtration member can be rotated about the hinge to provide access to the aperture of the basin.

In some embodiments, the grate extends over substantially all of the interior of the basin.

In some embodiments, the grate is recessed within the interior of the basin such that the grate is flush with the surface of the basin.

In some embodiments, the at least one pollutant collection member comprises a plurality of pollutant collection members, wherein each pollutant collection member of the plurality of pollutant collection members is spaced from one another so as to define a gap between each of the pollutant collection members through which the liquids received within the interior of the basin are channeled to bypass the plurality of pollutant collection members when the pollutant collection members become obstructed.

In some embodiments, the grate defines a plane and the at least one pollutant collection member is angled in relation to the plane defined by the grate.

In some embodiments, the basin defines a plurality of anchors, the plurality of anchors being configured to be secured to the surface.

In some embodiments, the surface comprises a roadway.

In some embodiments, a method of installing a drainage apparatus for receiving and channeling liquids from a surface is provided. The method comprises providing a basin defining an interior to receive the liquids and an aperture through which the received liquids are channeled. The method further comprises providing at least one pollutant collection member, the at least one pollutant collection member being porous. The method further comprises positioning the at least one pollutant collection member within the basin such that a substantial portion of the liquids received within the interior of the basin will impinge upon the pollutant collection member at an angle. The method further comprises positioning a grate on the basin, wherein the grate is supported by the basis and comprises a plurality of openings so as to enable the liquids to flow therethrough and into the interior of the basin, the grate defining a plane. The method further comprises the step of positioning the at least one pollutant collection member within the basin comprises positioning the at least one pollutant collection member at an angle in relation to the plane defined by the grate.

BRIEF DESCRIPTION OF DRAWINGS

Figure 1:
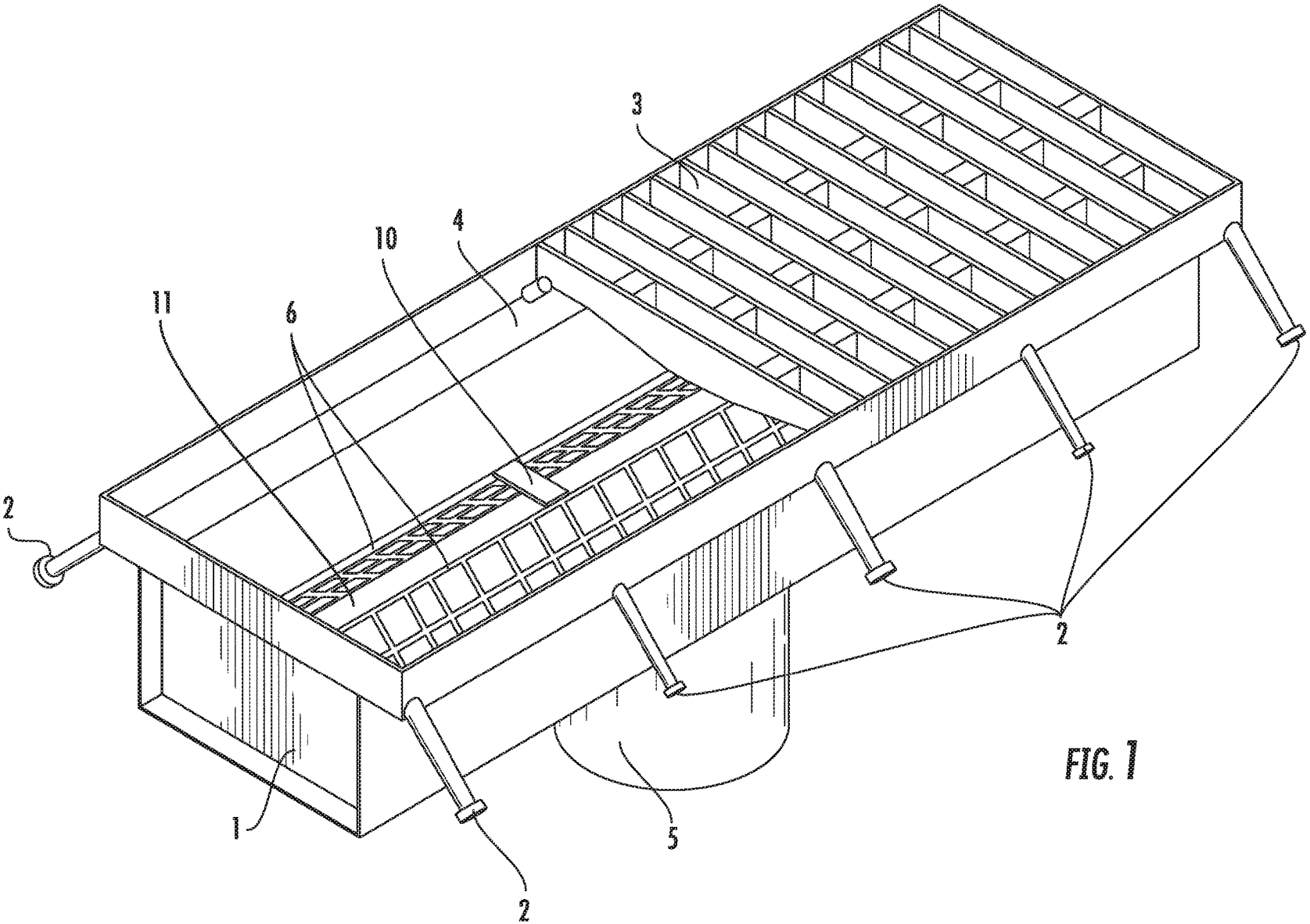
Figure 2:
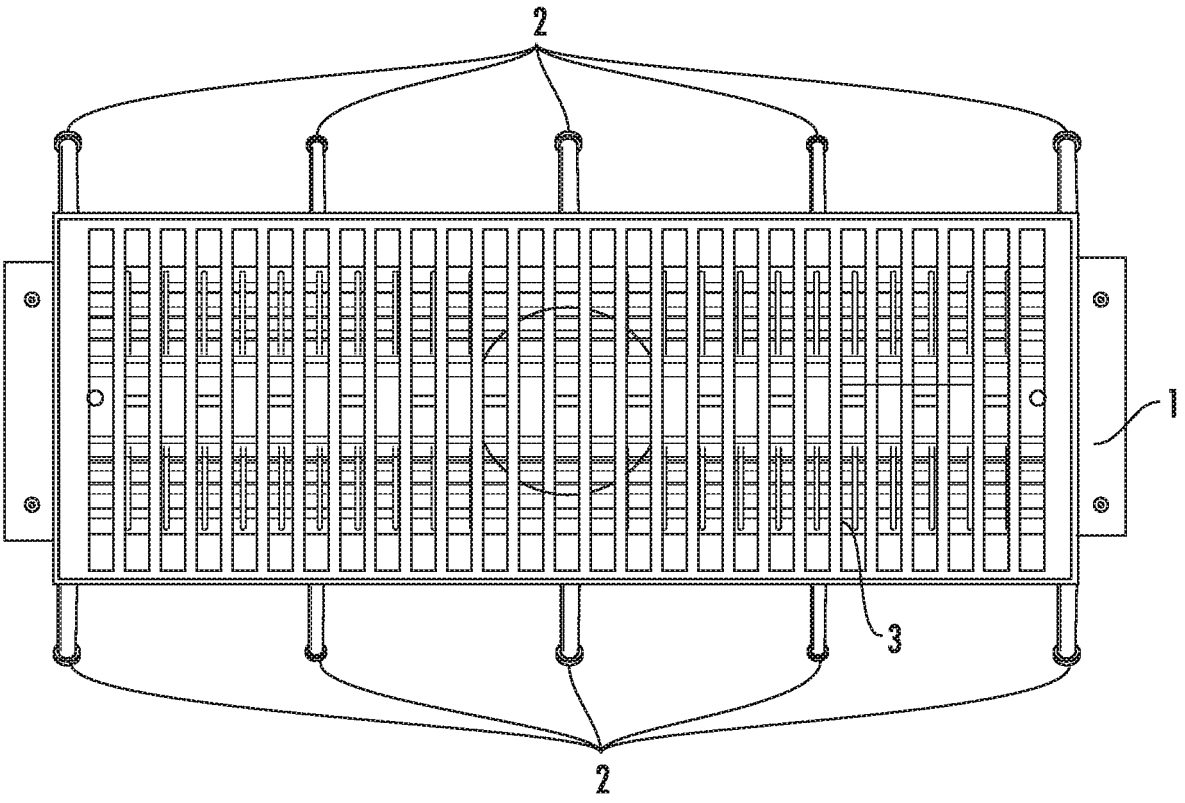
Figure 2:
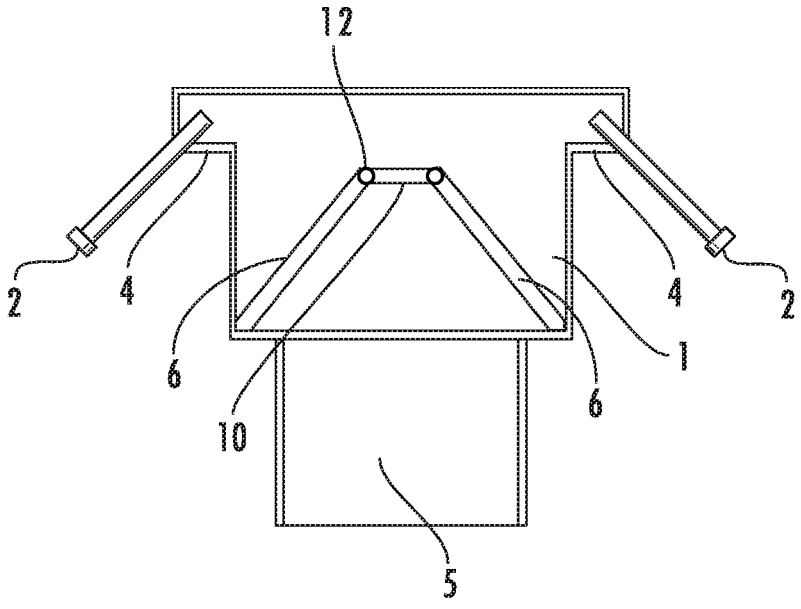
Figure 3:
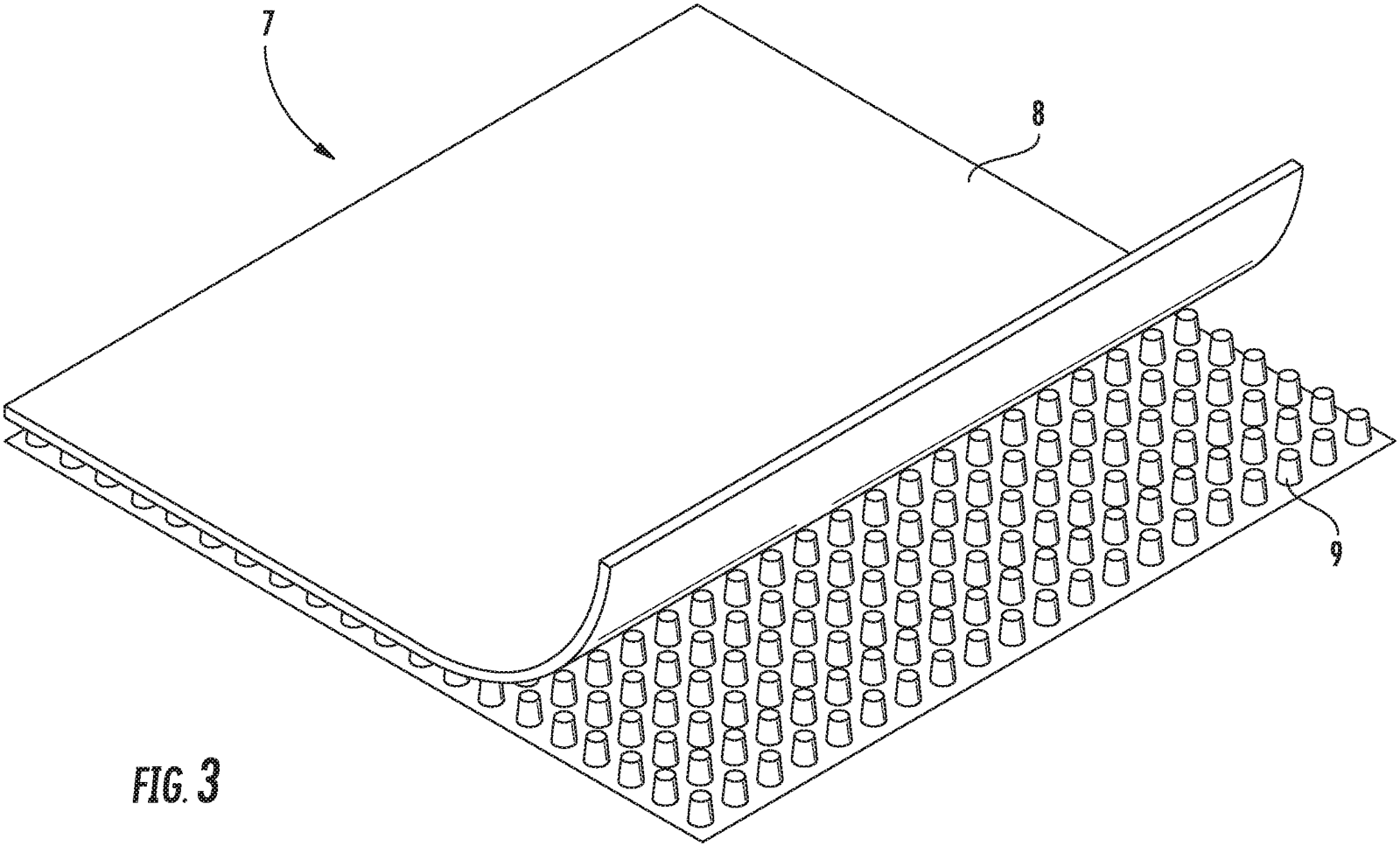

Having thus described embodiments of the invention in general terms, reference will now be made to the accompanying drawings, where:

FIG. 1 illustrates a perspective view of a drainage device, in accordance with embodiments of the present invention;

FIG. 2 illustrates a top view and a side view of a drainage device, in accordance with embodiments of the present invention; and FIG. 3 illustrates an exemplary fabric configuration, in accordance with embodiments of the present invention.

DETAILED DESCRIPTION OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

The present invention embodies a drainage device that is used for controlling the flow of rainwater during the "first flush" (i.e. the first fifteen to twenty minutes) of rainfall. Because the first flush of rainfall typically collects and carries loose pollutants from a surface (a driving surface, a road, a highway, or the like), there is a need to efficiently redistribute the flow of rainwater away from the surface.

The present invention may include a basin 1 as depicted in FIGS. 1 and 2. The basin 1 may define an interior, a length, a width, or a depth and may resemble a rectangular prism with solid side surfaces, solid end surfaces, a solid bottom surface, and an open top surface. The interior of the basin 1 is configured to receive liquids (e.g., rainwater) from a surface (e.g., a driving surface, a roadway, or the like) that are channeled through the open top surface of the basin 1. The side and end surfaces of the basin 1 are typically perpendicularly coupled to the bottom surface so that the basin 1 forms a bottom portion that resembles an open topped rectangular prism. The bottom surface of the basin 1 may be substantially flat (e.g., horizontal) or angled. The end surfaces of the basin 1 may be offset or recessed inwardly (e.g., recessed a distance from the edge of the bottom surface of the basin 1 toward the interior of the basin 1). The basin 1 may further include a top portion operatively coupled to the bottom portion that defines a length and width wider than those of the basin 1 and a depth shallower than that of the basin 1. Typically, the top portion of the basin 1 is coupled to the vertical surfaces of the edges of the side and end surfaces of the basin 1. The purpose of the basin 1 may be to receive rainwater as it flows away from the surface and separate pollutants from the rainwater. Pollutants may separate from the rainwater and settle on the bottom surface of or within the basin 1 for later removal or disposal. The basin 1 may be constructed from a solid material such as metal, an alloy, steel, aluminum, fiberglass, or the like. The basin 1 may also include areas for storing separated pollutants so that, after separation from the rainwater, the pollutants may be removed from the basin 1 and properly disposed. The basin 1 may also include an aperture 5 on its bottom surface through which rainwater or received liquids are channeled so that the liquids may exit after being processed by through the drainage apparatus of the present invention. Rainwater may flow through the aperture 5 and enter additional piping that is connected to a sewer or to another area for further processing, treatment, storage, or release of the water.

As illustrated in FIGS. 1 and 2, the basin defines a plurality of anchors 2. The plurality of anchors 2 are configured to secure the basin 1 to the adjacent surface (e.g., the roadway or sidewalk). These anchors 2 may be manufactured from metal (e.g., steel or aluminum), fiberglass, or the like and may or may not be threaded. In some embodiments, the anchors 2 may be operatively coupled to the basin 1 on an outside surface of the basin 1. In other embodiments, the basin 1 may define a plurality of boles on its side surfaces that are configured to receive the anchors 2, These holes may or may not be threaded. The anchors 2 may be angled in relation to the side surfaces or bottom surface of the basin 1, may be adjustable or tightenable, and in alternative embodiments may be utilized to secure a grate 3 (e.g., a drain) to the open top surface of the basin 1. In one embodiment, concrete or cement or a similar material is used to form the surface area around the basin and the anchors are embedded within such material when it is poured and become embedded within the structured formed by such material when it cures.

Rainwater flowing away from the surface may enter the basin 1 through the open top surface of the basin 1, or through the grate 3 (e.g., a solid, grated surface). The grate 3 includes a plurality of solid crossbars (e.g., a lattice) purposed to prevent large pollutants carried in the rainwater from entering the basin 1. The grate 3 also includes a plurality of openings or apertures through which rainwater (or other liquids) may flow, Rainwater typically is channeled through the plurality of openings in the grate 3 and then is received within the interior of the basin 1. Additionally, the grate 3 is detachedly or removably coupled to the basin 1 and may extend partially over the interior of the basin 1 as seen in FIG. 1. Alternatively, the grate 3 may extend over substantially all of the (e.g., the entire) interior of the basin 1 as seen in FIG. 2. In this way, the grate 3 either partially or wholly covers the open top surface of the basin 1. In some embodiments, the top portion of the basin 1 may include recessed edges 4 (e.g., edges recessed within the interior of the basin 1 from the top edge of the top portion of the basin 1) on which the grate 3 may rest so that the grate 3 is operatively coupled to the basin 1. In this way, the grate 3 is supported within the basin 1. The height of the recessed edges 4 may be substantially equal to the height of the grate 3 as displayed in FIG. 1 so that the grate 3 is flush with the surface of the basin 1. Additionally, the grate 3 may define a plane.

After rainwater flows into the basin 1, it may flow or he channeled through one or more pollution collection members 6. Each pollution collection member 6 typically comprises a support member and a filtration member secured to the support member. Each support member of the pollution collection member 6, perhaps resembling a latticed rectangular or other shaped) plane as shown in FIGS. 1 and 2, may define a length and a width that is less than the length and the width of the basin 1 so that each pollution collection member 6 may be housed or disposed within the interior of the basin 1. In one embodiment, each pollution collection member 6 (or each support member) is substantially planar in configuration. In another embodiment, each pollution collection member 6 (or each support member) comprises an uneven contour defining ridges and troughs. This uneven contour of each pollution collection member 6 (or each support member) increases surface area for more effectively trapping pollutants in the rainwater. Each pollution collection member 6 (or each support member) is typically constructed from a solid material such as metal, an alloy, steel, aluminum, fiberglass, or the like and may be grated (e.g., include a plurality of holes through which rainwater may flow). Each pollution collection member 6 is porous so as to enable rainwater to flow through the pollution collection member 6. In some embodiments, each pollution collection member 6 comprises a plurality of openings or apertures through which liquids received in the basin 1 (or liquids being received within the basin 1) are channeled. In this way, a substantial portion of the liquids received within the interior of the basin 1 will impinge upon each pollutant collection member 6. The pollution collection members 6 trap and collect pollutants found in the rainwater received within the interior of the basin 1. Trapped pollutants may then be extracted from the pollution collection members 6 (and thus the basin 1) for removal.

Each support member of each pollution collection member 6 is typically operatively coupled or secured to the basin 1 via a plurality of angled flanges 10. These flanges 10 may be permanently or detachedly coupled to the basin 1 and each support member of each pollution collection member 6. In some embodiments and as depicted in FIGS. 1 and 2, the flanges 10 may be resemble an "inverse-V" shape, wherein one support member is coupled to each sloped side of the flanges 10, In other embodiments, the flanges 10 may be hinged, allowing for a wide range of adjustability in multiple directions so that the support members (and thus the pollution collection members 6) may be positioned at a sloped angle in relation to the bottom surface of the basin 1, or in relation to another surface. Thus, the support member and filtration member of the pollution collection member 6 can be rotated about the hinge to provide access to the aperture 5 of the basin 1. Further, by angling the support members of the pollution collection members 6, the amount of surface area that is able to trap pollutants from the rainwater may be drastically increased. In this way, a more-angled pollution collection member 6 may trap more pollutants from the rainwater than another pollution collection member 6 that is not angled or less-angled. Therefore, a substantial portion of the liquids received within the interior of the basin 1 will impinge upon the pollutant collection member 6 at an angle. In one embodiment, the pollution collection members 6 are angled in relation to the plane defined by the grate 3.

In some embodiments, each pollutant collection member 6 is spaced from one another so as to define a gap between each of the pollutant collection members 6 through which rainwater (e.g., liquids) received within the interior of the basin 1 are channeled to bypass the pollutant collection members 6 when the pollutant collection members 6 become obstructed from trapped pollutants, liquids, or other substances. Alternatively, as shown in FIGS. 1 and 2, at the peak of the sloped pollutant collection members 6 (e.g., the point of the "inverse-V"), a similar bypass gap may exist between the pollutant collection members 6 and may enable rainwater to flow straight through the basin 1 of the present invention without passing through the pollutant collection members 6. For example, at a period in time after the first flush when the basin 1 is already full of water and separated pollutants, any newly received rainwater may flow straight through the bypass gap and channel into the aperture 5 at the bottom of the basin 1 for further processing or release. The aperture 5 may include a substantially vertical cylindrical extrusion or flume extending downwardly from the bottom surface of the basin 1 and configured to transport the rainwater received by the aperture 5 to a sewer, a water treatment facility plant, a reservoir or other body of water, or the like. The aperture 5 may be coupled to the basin 1 on any surface of the basin 1. In some embodiments, the flume may be operatively coupled to a pre-lain pipe or other liquid transportation device positioned underneath or adjacent to the drainage device of the present invention so that water received by the aperture 5 may exit the drainage device of the present invention and be transported to another location.

Furthermore, one or more filtration members 7, such as the one in FIG. 3, may be adhered, secured, or coupled to each support member of each pollution collection member 6. Typically, the fabric 7 may be formed from a bonded sheet assembly that includes a top layer 8 and a bottom layer 9. The top layer 8 may be manufactured from a formed polypropylene core fabric. The bottom layer 9 may be manufactured from a geo-textile fabric. Utilization of the fabric 7 on the each pollution collection member 6 may increase efficiency in filtering se pollutants from the flowing rainwater.

Each support member of each pollution collection member 6 is typically operatively coupled or secured to the basin 1 via a plurality of flanges 10. These flanges 10 may be permanently or detachedly coupled to the basin 1 and each support member of each pollution collection member 6. In some embodiments and as depicted in FIGS. 1 and 2, the flanges 10, when coupled to each support member of each pollution collection member 6, may resemble an "inverse-V" shape, wherein one support member is coupled to each sloped side of the flanges 10. In other embodiments, the flanges 10 may be coupled to each support member of each pollution collection member 6 by a hinge 12, allowing for a wide range of adjustability in multiple directions so that the support members (and thus the pollution collection members 6) may be positioned at a sloped angle in relation to the bottom surface of the basin 1, or in relation to another surface. Thus, each support member and filtration member 7 of each pollution collection member 6 can be rotated about a hinge 12 to provide access to the aperture 5 of the basin 1. Further, by angling the support members of the pollution collection members 6, the amount of surface area that is able to trap pollutants from the rainwater may be drastically increased. In this way, a more-angled pollution collection member 6 may trap more pollutants from the rainwater than another pollution collection member 6 that is not angled or less-angled. Therefore, a substantial portion of the liquids received within the interior of the basin 1 will impinge upon the pollutant collection member 6 at an angle. In one embodiment, the pollution collection members 6 are angled in relation to the plane defined by the grate 3.

In some embodiments, each pollutant collection member 6 is spaced from one another so as to define a gap between each of the pollutant collection members 6 through which rainwater (e.g., liquids) received within the interior of the basin 1 are channeled to bypass the pollutant collection members 6 when the pollutant collection members 6 become obstructed from trapped pollutants, liquids, or other substances. Alternatively, as shown in FIGS. 1 and 2, at the peak of the sloped pollutant collection members 6 (e.g., the point of the "inverse-V"), a similar bypass gap 11 may exist between the pollutant collection members 6 and may enable rainwater to flow straight through the basin 1 of the present invention without passing through the pollutant collection members 6. For example, at a period in time after the first flush when the basin 1 is already full of water and separated pollutants, any newly received rainwater may flow straight through the bypass gap 11 and channel into the aperture 5 at the bottom of the basin 1 for further processing or release. The aperture 5 may include a substantially vertical cylindrical extrusion or flume extending downwardly from the bottom surface of the basin 1 and configured to transport the rainwater received by the aperture 5 to a sewer, a water treatment facility plant, a reservoir or other body of water, or the like. The aperture 5 may be coupled to the basin 1 on any surface of the basin 1. In some embodiments, the flume may be operatively coupled to a pre-lain pipe or other liquid transportation device positioned underneath or adjacent to the drainage device of the present invention so that water received by the aperture 5 may exit the drainage device of the present invention and be transported to another location.

Furthermore, one or more filtration members 7, such as the one in FIG. 3, may be adhered, secured, or coupled to each support member of each pollution collection member 6. Typically, the filtration member 7 may be formed from a bonded sheet assembly that includes a top layer 8 and a bottom layer 9. The top layer 8 and/or bottom layer 9 may be manufactured from a formed polypropylene core fabric or a geo-textile fabric. Utilization of the filtration member 7 on each pollution collection member 6 may increase efficiency in filtering pollutants from the flowing rainwater.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A drainage apparatus for receiving and channeling liquids from a surface having a predetermined thickness, the apparatus comprising:

a basin defining an interior to receive the liquids and an aperture through which the received liquids are channeled;

a grate, the grate being supported by the basin, wherein the grate comprises a plurality of openings so as to enable the liquids to flow therethrough and into the interior of the basin;

at least one pollutant collection member, the at least one pollutant collection member being porous and being disposed within the basin such that a substantial portion of the liquids received within the interior of the basin will impinge upon the at least one pollutant collection member at an angle, wherein the at least one pollutant collection member comprises a pair of support members arranged within the basin in a generally inverse-V configuration, the generally inverse-V configuration defining an apex, wherein the at least one pollutant collection member further comprises at least one filtration member secured to each one of the pair of support members and at least one flange hinged to each one of the pair of support members at the apex of the inverse-V configuration such that each one of the pair of support members can be rotated about the hinge to provide access to the aperture of the basin.

2. A drainage apparatus according to claim 1, wherein the pair of support members comprises a lattice.

3. A drainage apparatus according to claim 1, wherein each filtration member comprises a plurality of layers.

4. A drainage apparatus according to claim 3, wherein at least one of the plurality of layers comprises a polypropylene fabric.

5. A drainage apparatus according to claim 3, wherein at least one of the plurality of layers comprises a geo-textile fabric.

6. A drainage apparatus according to claim 1, wherein the grate extends over substantially all of the interior of the basin.

7. A drainage apparatus according to claim 1, wherein the grate is recessed within the interior of the basin such that the grate is flush with the surface of the basin.

8. A drainage apparatus according to claim 1, wherein the at least one pollutant collection member comprises a plurality of pollutant collection members, wherein each pollutant collection member of the plurality of pollutant collection members is spaced from one another so as to define a gap between each of the pollutant collection members through which the liquids received within the interior of the basin are channeled to bypass the plurality of pollutant collection members when the pollutant collection members become obstructed.

9. A drainage apparatus according to claim 1, wherein the grate defines a plane and the at least one pollutant collection member is angled in relation to the plane defined by the grate.

10. A drainage apparatus according to claim 1, wherein the basin defines a plurality of anchors, the plurality of anchors being configured to be secured within the predetermined thickness of the surface.

11. A drainage apparatus according to claim 10, wherein the surface comprises a roadway.

12. A method of installing a drainage apparatus for receiving and channeling liquids from a surface having a predetermined thickness, the method comprising:

providing a basin defining an interior to receive the liquids and an aperture through which the received liquids are channeled;

providing at least one pollutant collection member, the at least one pollutant collection member being porous, wherein the at least one pollutant collection member comprises a pair of support members arranged within the basin in a generally inverse-V configuration, the generally inverse-V configuration defining an apex, wherein the at least one pollutant collection member further comprises at least one filtration member secured to each one of the pair of support members, and at least one flange hinged to each one of the pair of support members at the apex of the inverse-V configuration such that each one of the pair of support members can be rotated about the hinge to provide access to the aperture of the basin; and positioning the at least one pollutant collection member within the basin such that a substantial portion of the liquids received within the interior of the basin will impinge upon the at least one pollutant collection member at an angle.

13. A method according to claim 12, further comprising:

positioning a grate on the basin, wherein the grate is supported by the basin and comprises a plurality of openings so as to enable the liquids to flow therethrough and into the interior of the basin, the grate defining a plane; and wherein the step of positioning the at least one pollutant collection member within the basin comprises positioning the at least one pollutant collection member at an angle in relation to the plane defined by the grate.

* * * * *